US006152204A

United States Patent [19]

Santoro

[11] Patent Number: 6,152,204

[45] Date of Patent: Nov. 28, 2000

[54] DECORATIVE CORNICE

[76] Inventor: Jennifer K. Santoro, 3441 Morning Glory Rd., Dayton, Ohio 45449

[21] Appl. No.: 09/388,065

[22] Filed: Sep. 1, 1999

Related U.S. Application Data

[60] Provisional application No. 60/103,738, Oct. 9, 1998.

[51] Int. Cl.[7] ..... E04F 10/00

[52] U.S. Cl. ..... 160/38; 160/19; 160/39

[58] Field of Search ..... 160/19, 38, 39, 160/330; 40/773; 248/257, 262

[56] References Cited

U.S. PATENT DOCUMENTS

| | | | |
|---|---|---|---|
| 426,460 | 4/1890 | May | 160/38 |
| 1,070,042 | 8/1913 | Kottkay | 248/257 |
| 1,071,642 | 8/1913 | Kintz | 248/257 |
| 2,236,334 | 3/1941 | Duffek et al. | 248/257 |
| 2,293,662 | 8/1942 | Richardson | 160/19 |
| 2,689,103 | 9/1954 | Ackerman | 248/257 |
| 2,998,062 | 8/1961 | Bixby | 160/39 |
| 3,387,321 | 6/1968 | Janus | 248/262 |
| 4,033,061 | 7/1977 | Schulfoh et al. | 40/773 |
| 5,033,525 | 7/1991 | Paeselt | 160/39 |
| 5,039,049 | 8/1991 | Niemi | 160/39 |
| 5,042,549 | 8/1991 | Roberts | 160/39 |
| 5,144,997 | 9/1992 | Marasco et al. | 160/38 |
| 5,152,331 | 10/1992 | Barone | 160/38 |
| 5,345,990 | 9/1994 | Potts | 160/38 |
| 5,361,821 | 11/1994 | Barone | 160/39 |
| 5,505,245 | 4/1996 | Badalamenti | 160/38 |
| 5,597,025 | 1/1997 | Forkner | 160/38 |
| 5,927,362 | 7/1999 | Smiley et al. | 160/38 |
| 5,975,184 | 11/1999 | Nien et al. | 160/38 |

FOREIGN PATENT DOCUMENTS

| | | | |
|---|---|---|---|
| 165104 | 1/1934 | Switzerland | 160/38 |

*Primary Examiner*—Blair M. Johnson
*Attorney, Agent, or Firm*—William Weigl

[57] ABSTRACT

A cornice board has a base panel made of a relatively stiff foam material such as polystyrene. Padding and fabric cover the face side of the panel. The back side has a pair of brackets attached thereto and those brackets are affixed to a supporting surface, which in the case of a window cornice, would be a wall. Soft decorative objects such as dolls, landscaping, flowers, toys, etc. are easily attached in any location on the face side of the panel by means of special pins. Each bracket is of a simple two-piece construction that is separable and slidably justable to enable separate attachment of the bracket halves to the wall and panel back.

10 Claims, 2 Drawing Sheets

DECORATIVE CORNICE

This invention relates generally to decorative panels and means for suspending panels from supporting surfaces such as walls, and in particular, it relates to cornices mounted about curtains at the upper ends of windows. This application is based on my U.S. Provisional Patent Application 60/103738, filed Oct. 9, 1998.

BACKGROUND OF THE INVENTION

A conventional cornice board is typically constructed of an elongated horizontal wooden panel with side panels extending between the panel and the wall, in order to enclose or "box in" curtain rods at the upper ends of a window frame. Most commonly, the boards are covered with fabric of a texture and color or pattern which is felt to provide the most pleasing appearance. Materials other than wood are known to also have been used as cornice boards. For example, in U.S. Pat. No. 5,361,821, an elongated cornice made of semi-soft foam is slit along its back side and is supported on a stiffening plate which enters the slit. The foam is then covered with fabric through a wrap and tuck process. U.S. Pat. No. 5,345,990 illustrates foamed polyurethane with undulated mounds or curves, and slits between adjacent curves into which slits the fabric is tucked. In yet another U.S. Pat. No. 5,505,245, a resilient foam body is suspended from a horizontal curtain rod assembly. It too has slits for fabric-tucking purposes. More recently, there has been observed in a television infomercial a cardboard cornice which is attached to the back side of a soft foam elongated cornice. Together, the thin, apparently relatively flimsy cardboard and the foam piece or pieces are presumably of sufficient strength to maintain them relatively straight once fabric has been tucked into slits provided on the face and between the cardboard and the foam along the back. It would appear that use of this last-mentioned construction would be limited to shorter cornice lengths such as would cover standard double-hung window frames. While it is not clear from what has thus far been observed, it is believed that this latter design would be inadequate for a wide picture window of six feet or more in width, for example. It is not known whether it has been taught that one can selectively pin or similarly attach removable decorative objects to fabric-covered soft or semi-soft foam cornice boards to create special effects. This has been done with some padded wood frame cornice boards, where mention is made of attaching objects such as butterflies or flowers. (See U.S. Pat. No. 5,159,965). Another method which might possibly be considered decorating of a limited nature is to provide pouches for storing items by hanging them from curtain rods. This is shown in U.S. Pat. No. 5,785,188. Despite the volume of effort given to cornice treatment, no one appears to have provided a simple board structure that is self-sustaining without sag throughout and independent of its length, that is also capable of easy adjustable mounting to a supporting surface and that enables easy pinning of objects to its outwardly-facing side to provide an aesthetically pleasing appearance.

SUMMARY OF THE INVENTION

A cornice board has a base panel made of a relatively stiff foam material such as polystyrene. Padding and fabric cover the face side of the panel. The back side has a pair of brackets attached thereto and those brackets are affixed to a supporting surface, which in the case of a window cornice, is a wall. Soft decorative objects such as dolls, landscaping, flowers, toys, etc. are easily attached in any location on the face side of the panel by means of unique pins. The brackets are of a simple two-piece construction that is separable and slidably adjustable to enable separate attachment of the bracket halves to the wall and panel back.

It is a principal object of the invention to provide a unitary elongated panel forming the main element of a window cornice or other similar device, which panel is of a foam material having sufficient rigidity so as to be self-sustaining throughout, regardless of its length.

A further object is to provide such foam material panel with a porosity and firmness as to retain pins or screws made to penetrate the foam in a relatively tight relationship therewith.

Another object is to provide unique two-piece panel-mounting brackets which are slidably adjustable and separable for enabling ease of mounting and installation of cornice panels.

A further object is to provide a novel pin construction for mounting objects onto the face side of a base panel.

Other objects will become apparent from the following description, in which reference is made to the accompanying drawings.

DESCRIPTION OF THE PREFERRED EMBODIMENTS

The invention will be described herein primarily in connection with a horizontal cornice mounted on a vertical wall, the preferred use. However, it should be understood that the unitary structure and its mounting brackets can easily be a stand-alone wall decoration or a vertical decorative panel alongside a doorway, and the supporting surface might even in some circumstances be mounted on a ceiling or on an inclined wall section intermediate a ceiling and a vertical wall. Since the structure in each instance would be the same or quite similar, however, the description will be limited to a window cornice to simplify an understanding of the details of the invention.

Figure 1:
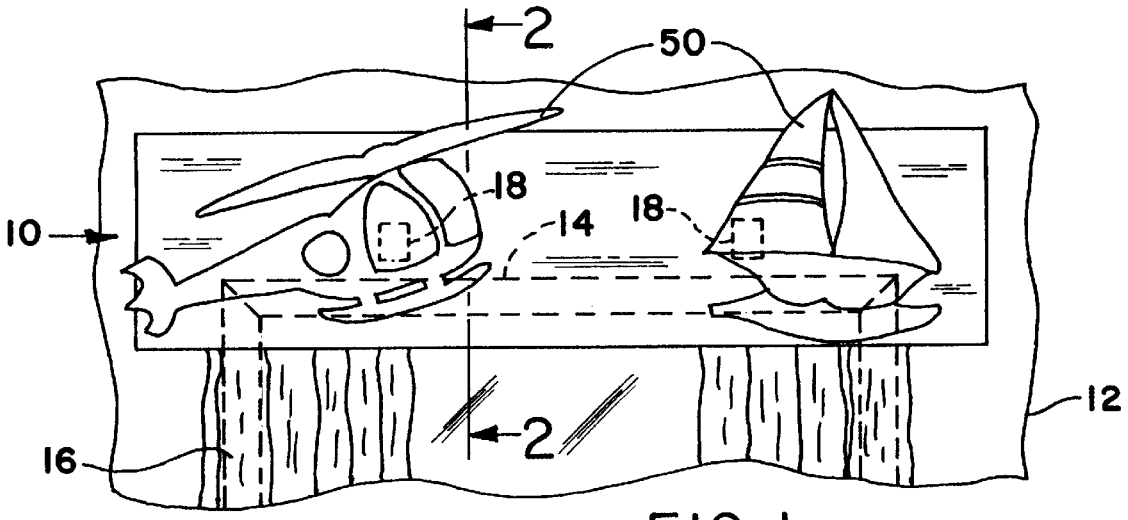
FIG. 1 shows the upper portion of a window frame with curtains and a decorative cornice of the invention at the top or upper end thereof.

Referring now to FIG. 1, a cornice 10 is shown as protruding outwardly from a wall 12 through which a window surrounded by a window frame 14 passes. The cornice covers the upper end of a set of curtains 16 suspended from conventional curtain rods (not shown). For supporting the cornice 10 from the wall 12, a pair of brackets 18 interconnect the two. The brackets are shown simply in dotted lines in FIG. 1 and will be described in greater detail in connection with FIG. 3. The brackets 18 are attached to the back side of a base panel 20 (FIG. 2) that constitutes the basic element of the cornice 10. Obviously, the positions of the brackets 18 must be such that there is no interference of the brackets with the curtains or curtain rods. They may, in some instances be required to be installed entirely outside the ends of the curtain rods, and as will be appreciated when their construction is later recognized, the brackets 18 may be positioned as inverted U-shaped elements straddling the rods if necessary.

One basic advantage of the simplicity of my invention is that the base panel 20 is made of a relatively low cost rigid common foam material slab which can be easily penetrated by pins or screws firmly secured to the panel in the positions in which they are placed. One such material is polystyrene sold under the registered trademark Styrofoam of Dow Chemical Company of Midland, Mich. The essential nature and dimensions of the material are that they be of sufficient strength and size so that an elongated horizontal slab or piece (such as is required to be used for a cornice) will be self-sustaining without sagging. This enables the brackets 18 to be placed wherever needed on the back side of the panel 18 and still provide a firm, essentially rigid cornice board. Wood has been commonly used for many years as cornice boards to provide the necessary rigidity. Where other materials have been used in place of wood, they required additional structure for their support, and if the structural element was relatively weak, the length of the cornice was limited. My preferred base panels can be provided in several lengths when sold in kit form for the do-it-yourself homemaker. In the version shown in FIGS. 1–4, they are sold in lengths of 54", 66" and 78". The base panels are preferably 12" in height and 2" thick for purposes of pinning decorative items thereto, as will be noted in connection with FIG. 4. I have found these dimensions to satisfactorily accommodate basic window frame sizes, simultaneously providing the rigidity to have a firm cornice which enables handling of the panel during mounting, changing the decorations when desired for seasonal purposes or for rearranging the locations of the mounted objects, all while allowing curtain removal and installation without risking damage to the cornice 10.

Figure 2:
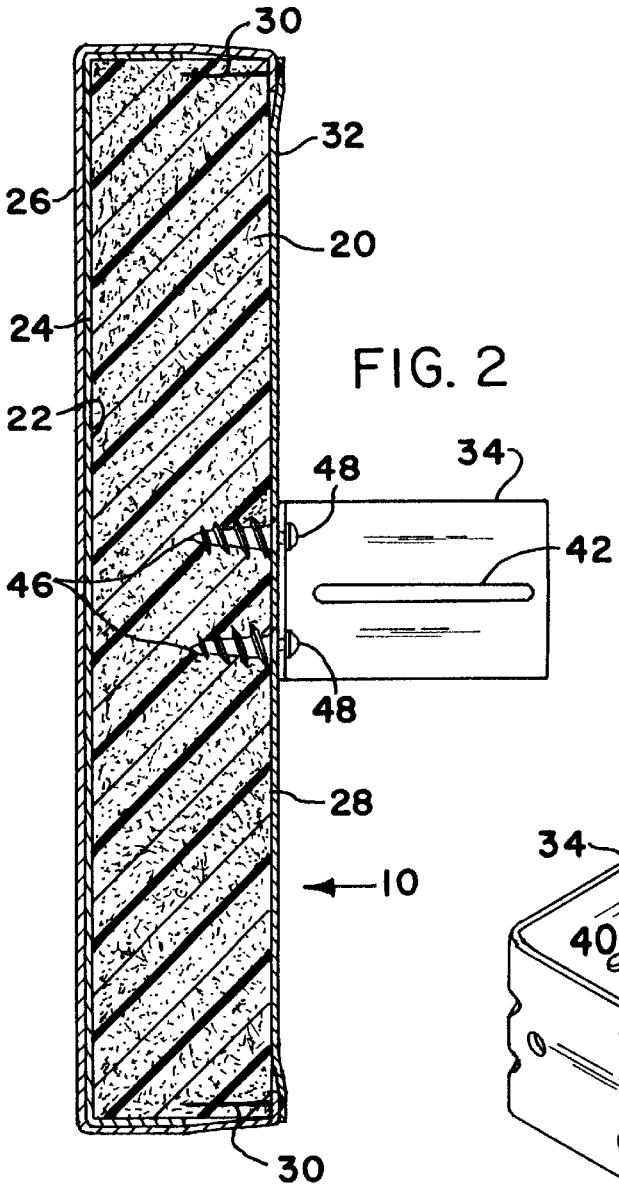
FIG. 2 is an enlarged vertical cross-sectional view of the base panel of the cornice as taken essentially along lines 2—2 of FIG. 1, also illustrating the attachment of one half of a bracket to the back side of the base panel.

Referring now to FIG. 2, the cornice can be easily constructed from a kit by first placing a felt batting 22 over the face 24 and adjacent edges of the base panel. The batting 22 smooths the corners surrounding the face side of the panel 20 so that a fabric covering 26 can nicely and pleasingly wrap around the edges where the face 24 meets the top, end and bottom edges of the panel 20. The fabric should be of an overall dimension which allows it to extend part way inwardly on the back side 28 of the panel 20. Conventional straight pins 30 can firmly hold the fabric in place in preparation for completing the rest of the construction. An adhesive-backed felt sheet 32 is placed over the edges of the fabric 26 on the back side 28, adhering to the back of the base panel and fabric covered by the felt 32. One known form of self-adhesive felt is manufactured by Aetna Felt Co., of Allentown, Pa. When this has been accomplished, the only things remaining for the FIG. 1–4 embodiment to be mounted on the wall is to attach one part of each bracket 18 to the back side 28 and to decorate the face side as desired. The latter is preferably done with ease after the panel has been mounted on the wall.

Figure 3:
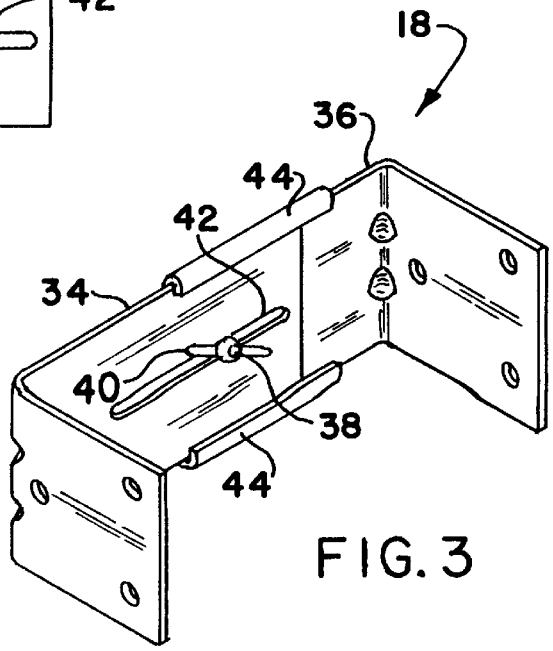
FIG. 3 is an isometric view of a bracket showing the separable and adjustably-slidable halves of each bracket.

One of the pair of brackets is shown in detail in FIG. 3. It comprises a first portion 34 and a second portion 36 secured thereto by a removable screw 38 and a wingnut 40. One portion has a slot 42 and the other has a pair of opposed guide channels 44 the obvious purpose of which is to allow adjustment of the space between the ends of the bracket portions 34 and 36. In my preferred embodiment, the spacing between the brackets ends is adjustable between 3" and 5". Once the necessary location of the brackets is determined by examining the locations of the curtain and rods, that spacing and distance relative to the height of the base panel can be measured and marked on the back side of the panel 20. I have found that plastic hollow screws such as Walldrillers 46, made by and a trademark of Cobra Fixations Cie Ltee of Montreal, Canada perform excellently for fastening one portion of each bracket to the panel 20. After marking the location for the Walldrillers 46, they are anchored to the panel 20 using only a screwdriver. The hollow portions of the Walldrillers then receive three screws 48 to securely fasten the first portions of the brackets 18 to the panel. After being positioned on the panel back side, the other bracket portion is fastened to the first portion with the screw 38 and wingnut 40 at a location along the slot 42 which it is determined will provide the necessary spacing of the panel from the wall. Once that has been accomplished, the assembly can be held in its final position and the locations for screwing the other bracket portions to the wall are appropriately marked. Since the type of wall installation depends on whether the unit is to be mounted onto wallboard, plaster or wood, the manner of connecting the finished unit to the wall is determined and accomplished accordingly.

Figure 4:
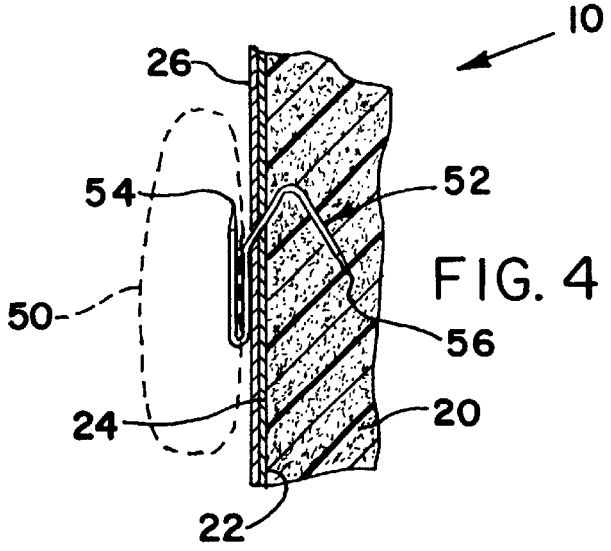
FIG. 4 is an enlarged cross-sectional view of the base panel illustrating the pin means of attaching a decorative object to the panel.

After mounting the cornice 10, it can now be decorated as desired, or the fabric left undecorated. FIG. 4 shows a soft cloth-covered object 50 having a Z-shaped pin 52 with sharpened points on each end. A first end 54 is positioned upwardly into the object 50 to support it from below. The second end 56 extends outwardly and downwardly from the Z and pierces the fabric 26 and foam material of the base panel 20. The object can thus be hung in any desired location on the face of the base panel. See for example the objects 50 hung from the cornice 10 of FIG. 1, where such cornice may be installed in a young boy's bedroom. The illustrated airplane and sailboat may have replaced soft toys which were used as decorations during the boy's earlier years. A feature of my invention is that, unlike conventional cornices, its decor may be easily and quickly varied as desired. Seasonal decorations, e.g., Christmas, Easter, Halloween, etc. are also possible, even for very short periods of time. This is due to the flexibility of locating the objects, and also due to the rigidity and strength of the polystyrene foam material used for the base panel.

Figure 5:
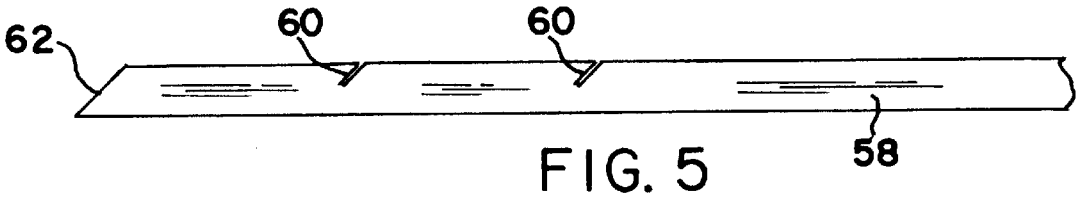
FIG. 5 is a top view of one end of a modified form of base panel that enables installation of a cornice either with or without side panels.
Figure 6:
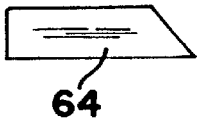
FIG. 6 is a top view of one of a pair of side panels that may be used in conjunction with the base panel of FIG. 5.
Figure 7:
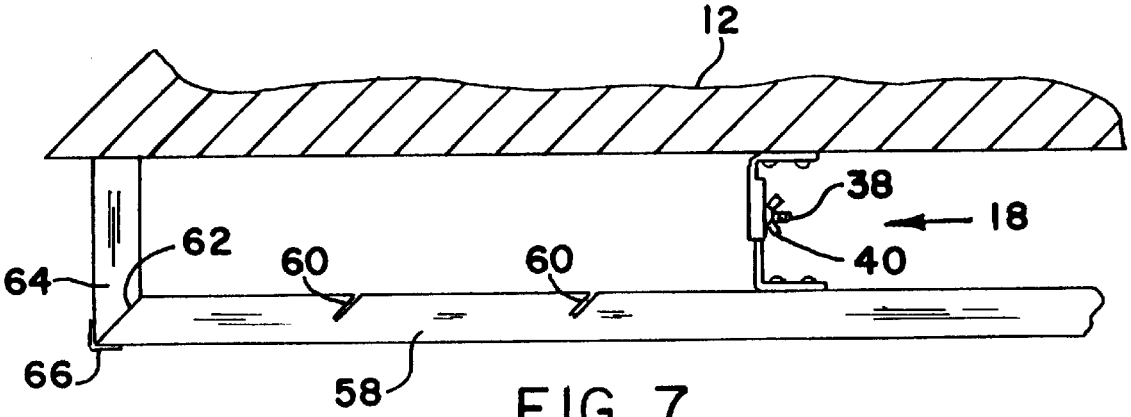
FIG. 7 is a fragmentary top view illustrating the means for mounting the modified version of FIGS. 5 and 6 onto a wall, omitting the details of fabric covering and attachable decorative objects for simplicity.

The preferred embodiment of my invention utilizes the blunt ends of the base panels, but did not include side panels extending from the base panel to the wall. Originally, I sought to eliminate the need for side panels, since they limit the distance the base panel can be placed from the wall. In the evolution of the invention, I found that I could feasibly add side panels while still retaining the primary features of my invention, should someone prefer side panels. The modification of my invention illustrated in FIGS. 5–7 illustrate that a base panel 58 of the kit can be formed as one length with forty-five degree partial slits 60 and mitered ends 62. Two slits 60 may extend inwardly from each of the ends 62 in 6" increments to allow for different length panels. By merely slitting the rest of the way through the foam material at a given slit 60 or slits, I can convert the panel length of the panel 58 to any of five different shorter lengths. Two side panels 64 are also provided. They would be the length of the maximum distance the cornice would be placed from the wall. Their blunt ends could be trimmed to a desired end length, with or without slits comparable to slits 60 being placed at right angles in one inch increments from the blunt ends. Additionally, if the base panel 58 is desired to be installed without side panels 64, the mitered ends can be trimmed at right angles to provide blunt ends. When side panels 64 are used, they are fastened to the base panel 58 at the outer comers with the self-adhesive felt 66 strip of material like that of 32 in FIG. 2. In this design, a self-adhesive felt sheet would extend in one piece over the back side of panel 58 and the insides of both side panels 64 to maintain them in their final positions. The brackets 18 may also be used to attach the modified version of cornice of FIG. 6 to the wall. I have not illustrated the remainder of the structure of this modification in the drawings since it was already described in connection with the preferred version of base panel.

Various changes may be made in the structure described without departing from the spirit and scope of the claims. For example, the base panel need not be rectangular, but can be irregular, oval or circularly shaped.

Having described my invention, I claim:

1. A cornice for decoratively dressing a room, comprising:

a horizontally elongated unitary base panel having a face side and a back side, said base panel being made of a firm plastic foam material having cross-sectional thickness and height dimensions to provide it with sufficient structural strength and rigidity whereby to be self-sustaining when supported intermediate its ends;

said base panel further having a porosity and firmness for gripping and retaining anchoring means therein and thereby enabling securement of a covering fabric around the face side of said panel and securement of supporting brackets to the back side of said panel;

at least two brackets each of which has a flange portion secured to the back side of said base panel intermediate its ends and a second portion extending generally perpendicularly to said base panel toward and being secured to a vertical wall supporting surface, said brackets providing the sole support for the base panel from the supporting surface;

a fabric covering the face side of said panel; and, a plurality of soft objects selectively positioned on the fabric-covered face side of the base panel by means of pins, each of which pins has a first end penetrating and supporting an object upwardly and a second end penetrating said base panel in a downward direction.

2. The invention according to claim 1 wherein the opposite ends of said base panel are mitered inwardly, and wherein a pair of side panels which are correspondingly mitered mate with the mitered ends of the base panel, thereby providing a three-sided cornice.

3. The invention according to claim 2 wherein the brackets are adjustable in length and wherein the side panels are trimmable in length between 3" and 5", whereby to selectively vary the distance of the base panel relative to the wall at the time of installation of the cornice.

4. A cornice for decoratively dressing the upper end of a window frame, comprising:

an elongated horizontal unitary base panel having a face side of a length at least as great as the horizontal dimension of the window frame to be dressed, said base panel being made of a plastic foam material having cross-sectional thickness and height dimensions to provide it with sufficient structural strength and rigidity whereas to be self-sustaining and resist sag along its length when supported generally adjacent its ends;

said base panel material further being of a porosity and firmness for gripping and retaining pins and screws therein and thereby enabling pin securement of a covering fabric to the face side of said panel and screw securement of supporting brackets to the side of said panel opposing said face side;

at least two brackets each of which has a flange portion secured to the opposing side of said base panel generally adjacent its ends and a second portion extending horizontally and generally perpendicularly to said base panel toward and being secured to a vertical supporting surface adjacent the window frame upper end, said brackets providing the sole support for the base panel from the supporting surface; and, a plurality of Z-shaped pins selectively positioning any of several different pin-piercable articles on said face side of the cornice, one end of each pin facing upwardly to pierce and liftingly support an article and the opposite end of said pin facing downwardly whereby to readily pierce and be supported by said base panel when an article is supported thereon.

5. The invention according to claim 4 wherein the horizontally extending portion of each said bracket is adjustable in length.

6. The invention according to claim 4 wherein each said bracket comprises a pair of L-shaped members the lower leg of one L being provided with screw holes for enabling screw attachment thereof to the opposing side of the base panel and the lower leg of the other L being provided with screw holes for enabling attachment thereof to a wall comprising the supporting surface, wherein cooperating inwardly-facing guide channels are provided on the upper legs of said L-shaped members, and wherein screw means is provided for fastening the upper legs together in a position of adjustment.

7. The invention according to claim 4 wherein said panel is generally rectangular and covered with a fabric, wherein said covering fabric fully covers the face side and all adjacent edges of said base panel and wherein portions of said fabric overlapping the opposing side of said panel are secured to the opposing side by means of pins pressed into said foam material.

8. The invention according to claim 7 wherein a self-adhesive sheet overlies the entire opposing side of said panel and said overlapping portions of fabric.

9. The invention according to claim 8 wherein each said bracket comprises a pair of L-shaped members, the lower leg of one L of a given pair being provided with screw holes for attachment to the opposing side of the base panel and the lower leg of the other L of said given pair being provided with screw holes for attachment to a wall comprising the supporting surface, wherein cooperating inwardly-facing guide channels are provided on the upper legs of said L-shaped members for slidably relatively adjusting said upper legs, and means for fastening the upper legs together in a position of adjustment.

10. The invention according to claim 9 wherein one of said upper legs of each pair is slotted lengthwise and the other upper leg of each pair is provided with a screw therein for receiving a wing nut, said screw passing through the slotted other upper leg whereby to accommodate relatively affixing the upper legs within an adjustable range corresponding to the length of the slot.

* * * * *